US006234308B1

(12) United States Patent
Saffron et al.

(10) Patent No.: US 6,234,308 B1
(45) **Date of Patent: *May 22, 2001**

(54) PRODUCT DISPLAY CONTAINER AND METHOD

(76) Inventors: David M. Saffron, 2108 Mt. Olympus Dr., Los Angeles, CA (US) 90046; Jack Saffron, 1030 S. Wooster Ave., #1, Los Angeles, CA (US) 90035

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/303,712

(22) Filed: Apr. 30, 1999

(51) Int. Cl.[7] ..... B65D 85/38

(52) U.S. Cl. ..... 206/316.2; 206/770; 206/776; 53/467

(58) Field of Search ..... 206/316.1, 316.2, 206/770–773, 775, 776, 777, 778, 461, 525, 525.1, 769, 781, 782; 53/467, 468, 449, 473, 474, 476

(56) References Cited

U.S. PATENT DOCUMENTS

| | | | | |
|---|---|---|---|---|
| D. 326,814 | | 6/1992 | Arai . | |
| 1,518,219 | * | 12/1924 | Peter | 206/769 |
| 2,498,757 | * | 2/1950 | High | 206/776 |
| 2,645,337 | * | 7/1953 | Stenger | 206/777 |
| 4,094,404 | | 6/1978 | Miller et al. . | |
| 4,180,165 | | 12/1979 | Kuchenbecker . | |
| 4,319,681 | * | 3/1982 | Gestetner | 206/776 |
| 4,353,461 | | 10/1982 | Liang . | |
| 4,739,353 | | 4/1988 | Heuer et al. . | |
| 4,804,984 | | 2/1989 | Heuer et al. . | |
| 5,337,099 | | 8/1994 | Tasaka et al. . | |
| 5,358,101 | * | 10/1994 | Lombardi | 206/776 |
| 5,409,105 | | 4/1995 | Appelbaum et al. . | |
| 5,602,612 | | 2/1997 | Angeli et al. . | |
| 5,673,796 | | 10/1997 | Tulloch . | |
| 5,711,424 | | 1/1998 | Kiesow . | |
| 5,738,211 | * | 4/1998 | Ichino et al. | 206/316.2 |
| 5,755,327 | * | 5/1998 | Saltzman et al. | 206/775 |

* cited by examiner

*Primary Examiner*—Luan K. Bui
(74) *Attorney, Agent, or Firm*—Martin & Ferraro, LLP

(57) ABSTRACT

The present invention is directed to a container assembly and method for displaying a product, e.g., a camera, for viewing by a consumer. In embodiments of the present invention, an inner permanent container is configured to accept a product in a cavity defined therein. Accordingly, the permanent container is preferably formed from a rigid material such as metal or plastic. The permanent container has a front surface that is either transparent or openable for displaying the contents thereof. For example, the front surface may include a cover that is moveable from an open to a closed position. The cover may be detachable from an open front surface of the permanent container and alternately attachable to its rear surface to expose the product contained therein. A temporary container, having at least a generally transparent front surface is configured to accept the permanent container having the product contained therein. Accordingly, the product contained within the permanent container can thus be viewed through the transparent surface of the temporary container and the open front surface of the permanent container. Once a product has been purchased by a consumer, the permanent container can be removed from the temporary container and the temporary container can be discarded. The product can then be stored within the permanent container by closing the openable front surface such as by attaching the detachable cover to the front surface of the permanent container.

13 Claims, 3 Drawing Sheets

PRODUCT DISPLAY CONTAINER AND METHOD

BACKGROUND OF THE INVENTION

1. Area of the Art

The present invention is directed to a container assembly and method for displaying a product contained therein to prospective consumers.

2. Description of the Prior Art

Various types of display packages are used to attract attention to products on store shelf displays. Typical of such packages are blister packages or the like which mount the product on a paper or cardboard backing member and surround the product on its front side with a transparent plastic blister. Such packages allow the product to be viewed by prospective consumers. After purchase, blister packages are typically discarded, leaving the product without any protection from its storage environment. Alternative display packages include packages that are reconfigurable from a display container to a gift container.

However, none of the prior display packages provide a permanent container for the product and a temporary container for receiving the permanent container that displays the contents of the permanent container through the temporary container.

SUMMARY OF THE INVENTION

The present invention is directed to a container assembly and method for displaying a product, e.g., a camera (disposable or non-disposable), for viewing by a consumer. In embodiments of the present invention, an inner permanent container is configured to accept a product in a cavity defined therein. Accordingly, the permanent container is preferably formed from a rigid material such as metal or plastic. The permanent container has a front surface that is either transparent or openable for displaying the contents thereof. For example, the front surface may include a cover that is moveable from an open to a closed position. The cover may be detachable from an open front surface of the permanent container and alternately attachable to its rear surface to expose the product contained therein. A temporary container, having at least a generally transparent front surface is configured to accept the permanent container having the product contained therein. Accordingly, the product contained within the permanent container can thus be viewed through the transparent surface of the temporary container and the open front surface of the permanent container. Once a product has been purchased by a consumer, the permanent container can be removed from the temporary container and the temporary container can be discarded. The product can then be stored within the permanent container by closing the openable front surface such as by attaching the detachable cover to the front surface of the permanent container.

In accordance with a preferred aspect of the present invention, the size of the product closely conforms to the size of a cavity defined by permanent container such that movement of the product within the permanent container is minimized during transport while still enabling insertion of the product within the permanent container. Similarly, the cavity defined by the temporary container is formed to allow insertion of the permanent container while still minimizing movement during transport.

In accordance with another preferred aspect of the present invention, the permanent container is made from a metallic material and the temporary container is formed from a plastic material. In accordance with still another preferred aspect of the present invention, the temporary container is formed from a single folded sheet of a plastic material.

The novel features of the invention are set forth with particularity in the appended claims. The invention will be best understood from the following description when read in conjunction with the accompanying drawings.

DETAILED DESCRIPTION OF THE INVENTION

The present invention is directed to a container assembly and method for displaying a product, e.g., a camera (disposable or non-disposable), for viewing by a consumer. In embodiments of the present invention, an inner permanent container, i.e., a container, is configured to accept the product in a cavity defined within. Accordingly, the permanent container is preferably formed from a metallic or rigid plastic material or other durable material. The permanent container has a front surface that is either transparent or openable and may have a cover that is detachable from an open front surface and alternately attachable to its rear surface to expose the product contained within. A temporary container, having at least a generally transparent front surface, is configured to accept the permanent container having the product contained within. Accordingly, the product can thus be viewed through the transparent surface of the temporary container and the open front surface of the permanent container. Once a product has been purchased by a consumer, the permanent container can be removed from the temporary container and the temporary container can be discarded. The product can then be stored within the permanent container by attaching the detachable cover to the front surface of the permanent container.

Figure 1:
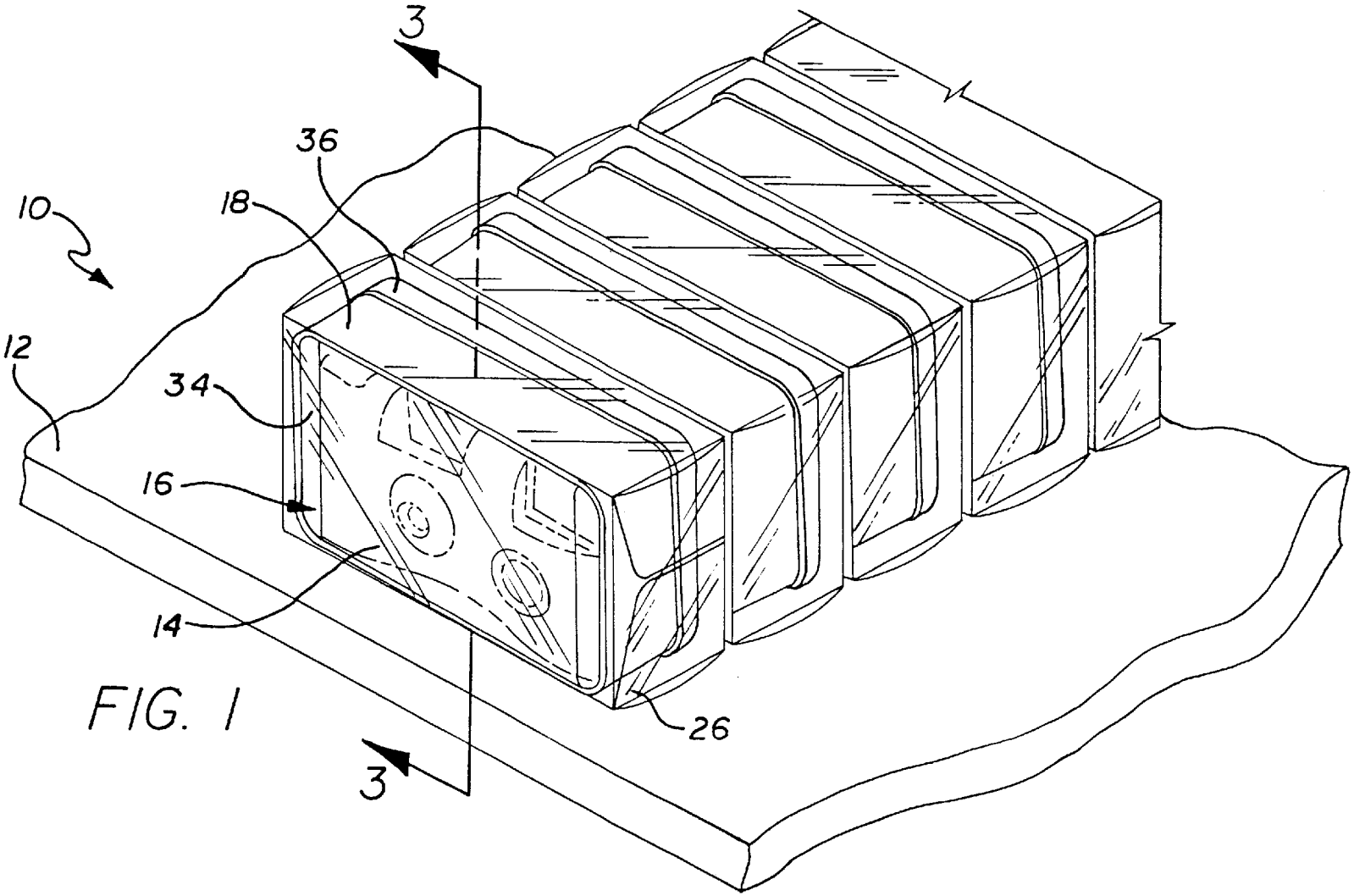
FIG. 1 is a perspective view of a row of product display containers of the present invention which enable viewing of an exemplary product, a camera, through its front surface when placed on a store shelf.

FIG. 1 is a perspective view of a row of display containers 10 of the present invention (displayed on a store shelf 12) which enable viewing of an exemplary product 14, a camera, through a facing such as its front surface 16. A display container 10 of the present invention primarily comprises: (1) a permanent container/casing 18 having a rear 20 and side walls 22 defining a cavity 24 within for containing the product 14; and (2) a temporary container 26 having front 28, rear 30, and side walls 32 for enclosing the permanent container/casing 18. Permanent container 18 has a transparent or an open front surface 34 and a detachable cover 36 that is alternately attachable to either open front surface 34 or rear surface 38 defined by rear wall 20. Temporary container 26 is formed such that front wall 28 defines a transparent facing such as front surface 40 which coincides with open front surface 34 of permanent container 18 when permanent container 18 is inserted within temporary container 26. Accordingly, product 14 can be viewed through front surface 16 of display container 10 by looking through front surface 40 of temporary container 26 and front surface 40 of permanent container 18. Additionally, temporary container 26 serves to protect container 18 and the product 14 contained within from damage.

Figure 2:
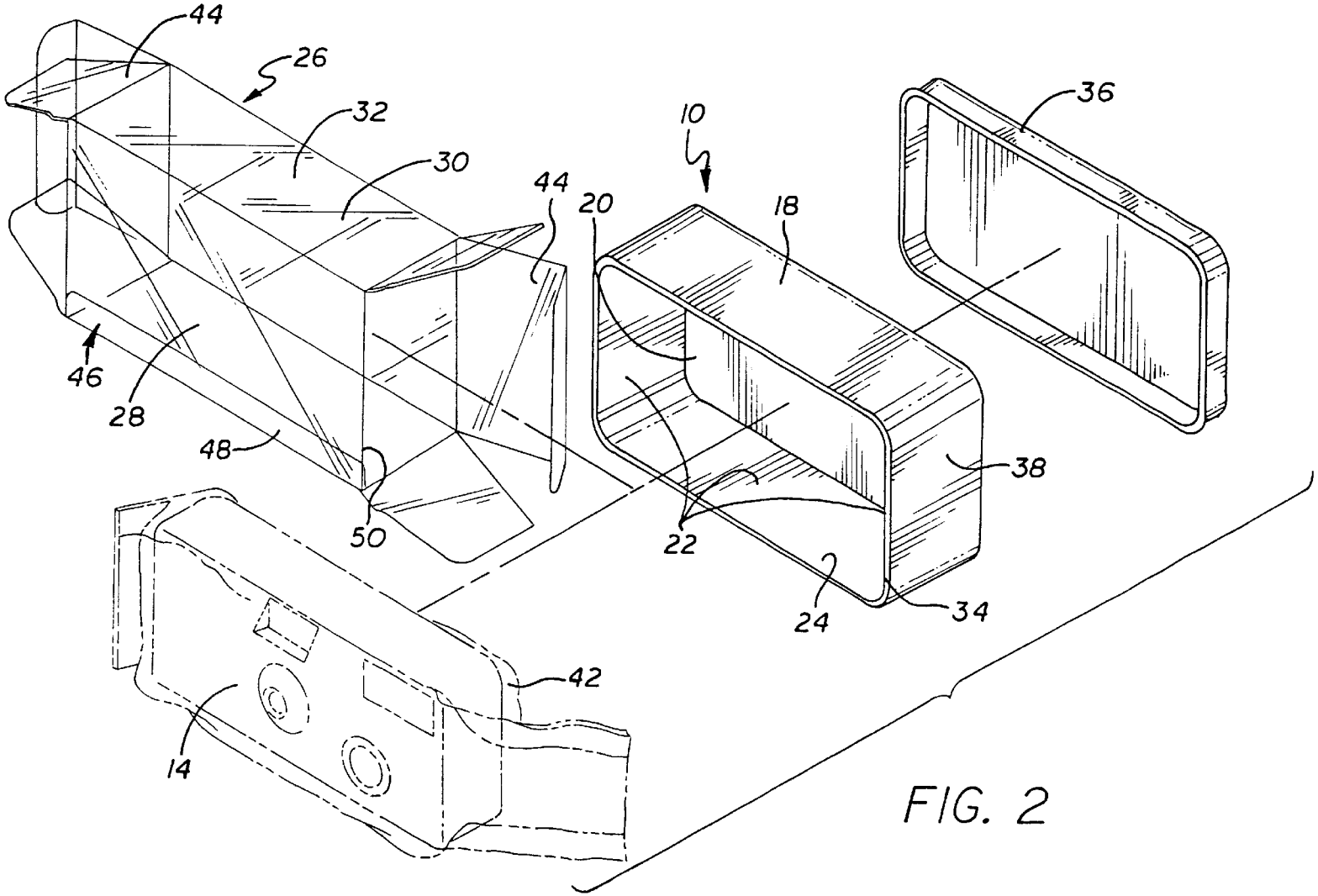
FIG. 2 is an exploded view showing the assembly of a product display container of the present invention and the insertion of an exemplary product, a camera, therein.
Figure 3:
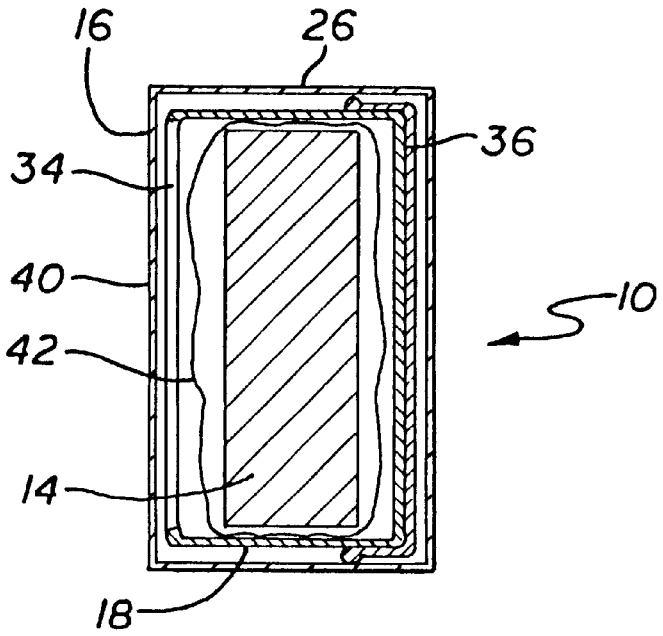
FIG. 3 is a cross section view of the display container of the present invention along section line 3—3 of FIG. 1.
Figure 4:
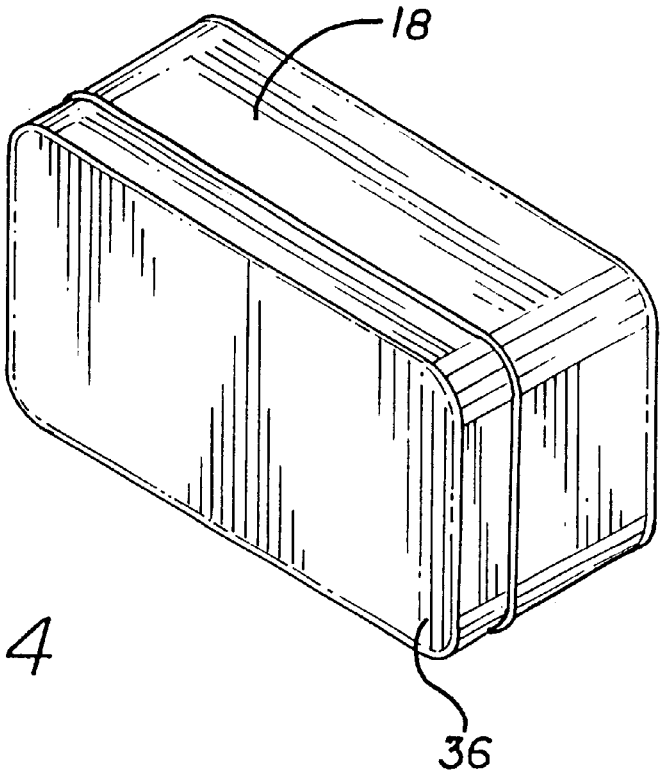
FIG. 4 is a perspective view of the permanent container having its cover moved from its rear/display position to a front/storage position for enclosing the product.

FIG. 2 is an exploded view showing the assembly of display container 10 of the present invention and the insertion of an exemplary product 14, a camera, within. Product 14 may be contained within a sealed plastic wrapping 42 to provide additional protection for product 14 while allowing the product to be seen. In operation, product 14 is first inserted within permanent container 18. Preferably, cover 36 is attached, e.g., snapped, to rear surface 38 of permanent container 18. Next, the assembly (i.e., product 14, permanent container 18 and its cover 36) is slid into temporary container 26. Once placed within temporary container 26, end flaps 44 of temporary container 26 are sealed and display container 10 can now be placed on display on the store shelf 12. A cross section view of the resulting display container 10 is shown in FIG. 3.

Preferably, temporary container 26 is formed from a single sheet 46 of a flexible, transparent material, e.g., a plastic sheet. Sheet 46 is essentially transparent, i.e., sufficiently transparent to allow a user to view product 14 contained within. Sheet 46 is formed in a pattern suitable to form a container and folded using known techniques. The container can be in the shape of a box for example. A bonding seam 48 is formed using tape, cement or any known bonding technique, resulting in a rectilinear tube 50 having end flaps 44 at each end. While the bonding seam 48 is shown on front surface 40 of temporary container 26, it may be oriented on any of the faces. End flaps 44 are folded to close temporary container 26 once permanent container 18 is placed therein. One or more of end flaps 44 may optionally be permanently coupled to rectilinear tube 50 using tape or other bonding techniques. The resulting temporary container 26 defines a cavity 52 large enough to contain the permanent container 18 therein.

Permanent container 18 is preferably formed of a rigid material such as a metallic (e.g., aluminum or tin) or plastic type material suitable for storing product 14. Preferably, detachable cover 36 is formed of a similar material and configured to removably engage either front surface 34 or rear surface 38 of permanent container 18. Accordingly, once product 14 has been purchased in the display container 10, a consumer can remove permanent container 18 from temporary container 26 and use product 14 contained therein. Later, the product 14 can be returned to permanent container 18 for storage. In this mode, detachable cover 36 is coupled, e.g., snapped, to front surface 34.

For example, a typical use of the exemplary camera product 14 follows. Following purchase, permanent container 18 is removed from temporary container 26 and temporary container 26 is discarded. Product 14, such as a camera, would then be removed from the plastic wrapper 42 (if present) and the plastic wrapper 42 would also be discarded. Typically, product 14 would then be used by the consumer. Product 14 would then be returned to permanent container 18 and detachable cover 36 would be coupled to its front surface 34, to store and protect product 14 contained within.

Preferably, the size of product 14 closely conforms to the size of cavity 24 defined by permanent container 18 such that movement of product 14 within permanent container 18 is minimized during transport while still enabling insertion of product 14 within permanent container 18. Similarly, cavity 52 defined by temporary container 26 is formed to allow insertion of permanent container 18 while still minimizing movement during transport. While generally close tolerances are desired, some of these tolerances may be accommodated by flexibility of temporary container 26, permanent container 18 and product 14 contained within.

Although the present invention has been described in detail with reference only to the presently-preferred embodiments, those of ordinary skill in the art will appreciate that various modifications can be made without departing from the invention. For example, while the disclosure has primarily shown rectilinear shaped containers for the temporary and permanent containers, other shapes are also considered to be within the scope of the present invention. Also, the temporary container may also include advertising or other informational material to assist in selling the product and permanent container may include a decorative or other type coatings. Furthermore, while the display container has been shown on a store shelf, the present invention can also include embodiments where the temporary container in configured for mounting on a hook type display. Other variations that include a permanent and a transparent temporary container are also considered to be within the scope of the present invention. Accordingly, the invention is defined by the following claims.

We claim:

1. A product display container for displaying a product contained therein, said product display container and product comprising:

a product having an overall external shape;

a permanent rigid container having an external shape generally corresponding to the overall external shape of said product and an interior for containing said product, said interior being dimensioned to be only slightly larger than said product, said product being dimensioned to closely conform to the size and shape of said interior of said permanent container so as to minimize movement of said product within said permanent container, said permanent container including ornamental indicia on its outer surface and having a first facing configured to display at least a portion of said product contained therein; and a temporary container sized to closely conform to the size and shape of the permanent container and to receive said permanent container so as to minimize movement of said permanent container within said temporary container, said temporary container having a plurality of generally transparent second facings configured to display at least a portion of said permanent container and said product contained therein such that said product is visible through said first facing of said permanent container and at least one of said second facings of said temporary container and the ornamental indicia of said permanent container is fully visible through at least one of said second facings of said temporary container.

2. The product display container of claim 1, wherein said permanent container further includes a casing having an open front surface and an opposite closed rear surface; and a cover for mating with the rear surface of said casing, said cover also sized to mate with said open front surface.

3. The product display container of claim 1, wherein said temporary container is generally transparent on all facings of said temporary container.

4. The product display container of claim 1, wherein said temporary container is formed from a single, folded sheet of substantially transparent material.

5. The product display container of claim 1, wherein said permanent container has a first cavity therein for accepting said product and said temporary container has a second cavity therein, larger than said first cavity, for accepting said permanent container with said product contained therein.

6. The product display container of claim 1, wherein said permanent container comprises a metallic material.

7. The product display container of claim 1, wherein said temporary container is formed from a plastic material.

8. A method for displaying a product, comprising the steps of:

providing a product having an overall external shape;

providing a permanent rigid container having an external shape general corresponding to the overall external shape of said product and an interior for containing said product therein, said interior being dimensioned to be only slightly larger than said product, said permanent container having a first facing configured to display at least a portion of said product contained within said permanent container;

placing said product within said permanent container, said product being dimensioned to closely conform to the size and shape of said interior of said permanent container so as to minimize movement of said product within said permanent container;

providing a temporary container having a plurality of generally transparent second facings and being configured in size and shape to closely conform to the size and shape of said permanent container and to receive said permanent container so as to minimize movement of said permanent container within said temporary container;

inserting said permanent container containing said product within said temporary container such that the entire outer surface of the permanent container is displayed through said second facings of said temporary container; and displaying said product through said first facing of said permanent container and second facings of said temporary container.

9. The method of claim 8, wherein said inserting step includes the sub-step of opening at least one facing of said temporary container to facilitate inserting said permanent container within said temporary container.

10. The method of claim 9, further comprising the step of closing said at least one facing of said temporary container to enclose said permanent container within said temporary container.

11. The method of claim 8, wherein the step of providing a permanent container includes the sub-step of providing said permanent container comprising ornamental indicia on its outer surface, a casing having an open front surface and an opposite closed rear surface and a cover configured for covering the front surface of said casing to enclose said product.

12. The method of claim 11, wherein said providing sub-step includes the sub-step of coupling said cover to the rear surface of said permanent container before placing said permanent container within said temporary container.

13. A method for displaying a product, comprising the steps of:

providing a product having an overall external shape;

providing a permanent rigid container having an external shape generally corresponding to the overall external shape of said product and an interior for containing said product therein, said interior being dimensioned to be only slightly larger than said product, said permanent container having ornamental indicia on its outside surface and a first facing for displaying said product contained within said permanent container, said product being dimensioned to closely conform to the size and shape of said interior of said permanent container so as to minimize movement of said product within said permanent container;

placing said product within said permanent container;

providing a temporary container for receiving said permanent container, said temporary container having a plurality of generally transparent second facings, wherein the temporary container is configured in size and shape to closely conform to the size and shape of said permanent container so as to minimize movement of said permanent container within said temporary container;

inserting said permanent container containing said product within said temporary container such that the ornamental indicia of said permanent container are displayed through said second facings of said temporary container; and displaying said product through said first facing of said permanent container and said second facings of said temporary container.

* * * * *